US006293436B2

(12) United States Patent
Faughnder et al.

(10) Patent No.: US 6,293,436 B2
(45) **Date of Patent: *Sep. 25, 2001**

(54) LIQUID CONTAINER WITH EXTENSIBLE DISPENSING TUBE

(75) Inventors: David J. Faughnder; Lanny A. Gorton, both of San Diego, CA (US)

(73) Assignee: WD-40 Company, San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/431,971

(22) Filed: Oct. 29, 1999

(51) Int. Cl.[7] ..... B65D 37/00
(52) U.S. Cl. ..... 222/211; 222/464.5; 222/529
(58) Field of Search ..... 222/211, 215, 222/464.3, 464.5, 527, 529, 538

(56) References Cited

U.S. PATENT DOCUMENTS

| | | | | |
|---|---|---|---|---|
| 1,778,291 | * | 10/1930 | Burke | 222/211 |
| 2,723,056 | | 11/1955 | Smith | 222/396 |
| 3,050,217 | * | 8/1962 | Mackey | 222/211 |
| 4,925,128 | | 5/1990 | Brody | 222/221 |
| 5,388,712 | | 2/1995 | Brody | 215/229 |
| 6,070,769 | * | 6/2000 | Hornsby | 222/529 |

FOREIGN PATENT DOCUMENTS

| | | | | |
|---|---|---|---|---|
| 735659 | * | 8/1955 | (GB) | 222/211 |
| 1580074 | | 7/1977 | (GB) . | |

* cited by examiner

*Primary Examiner*—Joseph A. Kaufman
(74) *Attorney, Agent, or Firm*—Michael H. Jester

(57) ABSTRACT

A liquid dispensing container of the squeeze bottle type has a low center of gravity liquid bottle with a hemispherical base portion and a frusto-conical neck portion. A spout assembly is coupled to an upper end of the neck portion for dispensing liquid when a deformable bottom wall of the base portion of the bottle is flexed. The spout assembly includes a bottle cap with a through bore in which a flexible dispensing tube is slidably extensible and retractable to dispense liquid, such as lubricating oil, into locations that would otherwise be inaccessible. A wiper element in the bottle cap associated with the through bore provides a liquid impervious seal between the bottle cap and the tube and ensures that excess liquid on the outer surface of the tube is scraped off as the tube is extended. A nozzle is connected to a distal end of the tube and a pop-up sealing cap is slidable back and forth over the nozzle to selectively open and close a dispensing hole in the pop-up cap.

40 Claims, 10 Drawing Sheets

LIQUID CONTAINER WITH EXTENSIBLE DISPENSING TUBE

BACKGROUND OF THE INVENTION

The present invention relates generally to the field of liquid dispensers of the type commonly known as squeeze bottles. More particularly, the present invention relates to liquid containers that can be squeezed to dispense viscous liquids, such as lubricating oil into otherwise inaccessible areas.

Squeeze bottles have long been used for dispensing viscous liquids such as ketchup, honey, body lotion, glue, industrial oil, and so forth. Typically they comprise a cylindrical hollow body that forms a liquid reservoir and a spout assembly with a nozzle or other outlet that is sealed with a cap after use to prevent spillage and/or evaporation. One type of squeeze bottle that has become popular for dispensing lubricating oil has an elongated hollow spout assembly that accommodates a flexible tube that is normally contained within a deformable, cylindrical bottle and which is slidably extensible from the distal tip of the spout assembly for dispensing oil into hard-to-reach locations. See for example U.S. Design Patent No. Des. 200,364 of Brody and U.S. Pat. No. 4,925,128 of Brody. Such squeeze bottles frequently suffer from leakage at the interface between the tube and the surrounding extension of the spout assembly. They also use sealing caps that are tedious to remove and replace, and often become lost. In addition, this type of squeeze bottle can dispense excessive amounts of oil when squeezed and easily tips over when placed upright on a support surface, especially when the extensible tube is fully extended. If the sealing cap is not securely fit over the distal end of the tube, a messy oil spill results. U.S. Pat. No. 5,388,712 of Brody discloses a squeeze bottle having an extensible tube with a fluted plug molded on the base of the cap assembly. The tube can be bent over so that the plug can be inserted into the orifice in the end of the tube. However, this can lead to crimping and/or permanent bending of the tube of the tube. Also, considerable lateral forces are exerted on the plug by the tube when they are mated such that the plug bends over.

SUMMARY OF THE INVENTION

It is therefore the primary object of the present invention to provide an improved liquid container of the squeeze bottle variety that employs an extensible dispensing tube which overcomes the drawbacks of prior art liquid containers of this type.

In accordance with a first aspect of our invention, a liquid dispensing container includes a deformable bottle for holding a quantity of a liquid to be dispensed and a spout assembly coupled to an end of the bottle for selectively dispensing from the bottle a small portion of the quantity of liquid previously supplied to the interior of the bottle. The spout assembly includes a bottle cap having a through bore and a flexible tube slidably extensible within the through bore out of the bottle and slidably retractable within the through bore back into the bottle. The tube has a proximal end for receiving the quantity of liquid within the bottle and a distal end for delivering the liquid out of the bottle. The spout assembly further includes a wiper element that extends radially inwardly adjacent the through bore. The wiper element provides a substantially liquid impervious seal between the bottle cap and the tube. The wiper element scrapes off liquid from the tube when the tube is slidably extended from the bottle.

According to another aspect of our invention a liquid dispensing container includes a deformable bottle for holding a quantity of a liquid to be dispensed and a spout assembly coupled to an end of the bottle for selectively dispensing a small portion of the quantity of liquid previously supplied to the interior of the bottle. The spout assembly includes a bottle cap having an annular through bore and a flexible tube slidably extensible within the through bore out of the bottle and slidably retractable within the through bore back into the bottle. The tube has a proximal end for receiving the quantity of liquid within the bottle and a distal end for delivering the liquid out of the bottle. The spout assembly further includes a nozzle that is coupled to the distal end of the tube and has at least one dispensing orifice and a pop-up cap coupled to the nozzle and selectively movable between retracted and extended positions for sealing and unsealing the dispensing orifice.

According to yet another aspect of our invention a liquid dispensing container includes a deformable bottle for holding a quantity of a liquid to be dispensed and a spout assembly coupled to an upper neck portion of the bottle for selectively dispensing a small portion of the quantity of liquid in the bottle. The bottle has a generally hemispherical lower base portion that is connected to the upper neck portion. The spout assembly includes a bottle cap having a through bore. The spout assembly further includes a flexible tube slidably extensible within the through bore out of the bottle and slidably retractable within the through bore back into the bottle. The tube has a proximal end for receiving the quantity of liquid within the bottle and a distal end for delivering the liquid out of the bottle.

According to still a further aspect of our invention a liquid dispensing container includes a unitary molded bottle for holding a quantity of a liquid to be dispensed. The bottle has a generally hemispherical lower base portion and an elongated upper neck portion for providing a low center of gravity to reduce the likelihood of inadvertent tipping over of the bottle. The base portion of the bottle includes a deformable bottom wall portion that can be manually depressed to force liquid from the bottle through the neck portion. The container further includes a spout assembly coupled to an upper end of the neck portion of the bottle for dispensing a small portion of the quantity of liquid in the bottle when the flexible bottom wall portion of the bottle is manually depressed.

According to yet another aspect of our invention a liquid dispensing container includes a unitary, injection molded plastic bottle for holding a quantity of a liquid to be dispensed. The bottle has a generally hemispherical lower base portion and an elongated generally frusto-conical upper neck portion. This bottle configuration provides a low center of gravity to reduce the likelihood of inadvertent tipping over of the bottle. The base portion of the bottle includes a deformable bottom wall portion that can be manually depressed to force liquid from the bottle through the neck portion. A spout assembly is coupled to an upper end of the upper neck portion for dispensing a small portion of the quantity of liquid in the bottle when the flexible bottom wall portion of the bottle is manually depressed. The spout assembly includes a bottle cap having a shoulder portion defining an annular through bore. The spout assembly further includes a flexible tube slidably extensible within the through bore out of the bottle and slidably retractable within the through bore back into the bottle. The tube has a proximal end for receiving the quantity of liquid within the bottle and a distal end for delivering the liquid out of the bottle. The spout assembly further includes an annular wiper element extending radially inwardly and downwardly adjacent the shoulder portion of the bottle cap for providing a substantially liquid impervious seal between the shoulder portion of the bottle cap and the tube. The wiper element also scrapes off liquid from the tube when the tube is slidably extended from the bottle. A nozzle component of the spout assembly is coupled to the distal end of the tube and has at least one dispensing orifice. A pop-up cap component of the spout assembly is coupled to the nozzle and is selectively movable between retracted and extended positions for sealing and unsealing the dispensing orifice. The nozzle is formed with a sealing plug at its distal end which is received in a hole in the pop-up cap when the pop-up cap is in its retracted position. The sealing plug is withdrawn from the hole when the pop-up cap is in its extended position.

DESCRIPTION OF THE PREFERRED EMBODIMENT

Figure 1:
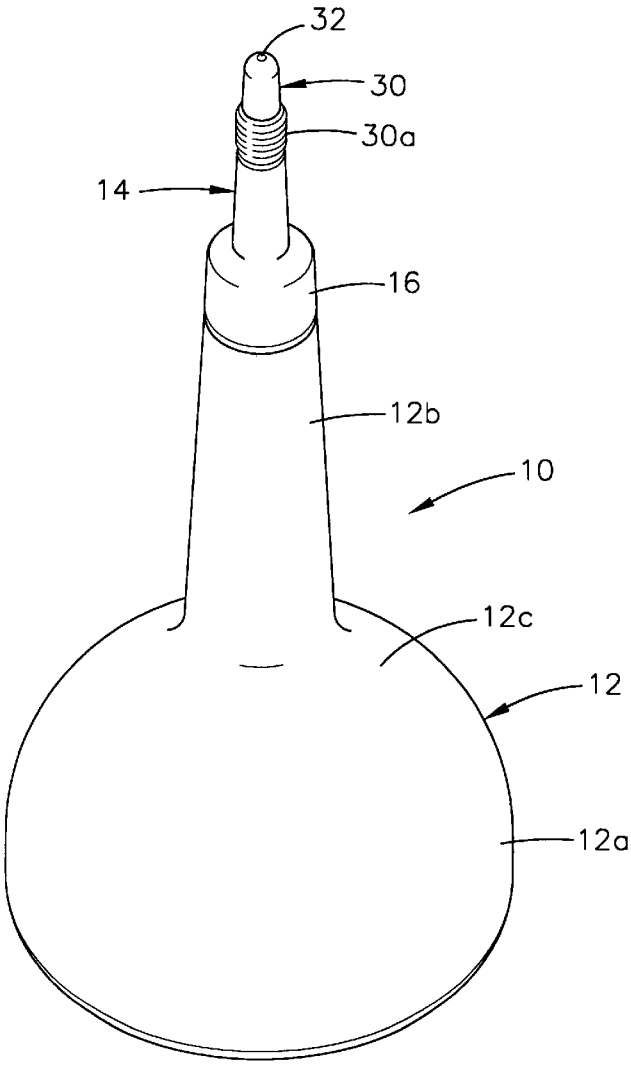
FIG. 1 is a perspective view of a preferred embodiment of the liquid dispensing container of the present invention taken from the top side thereof.
Figure 4:
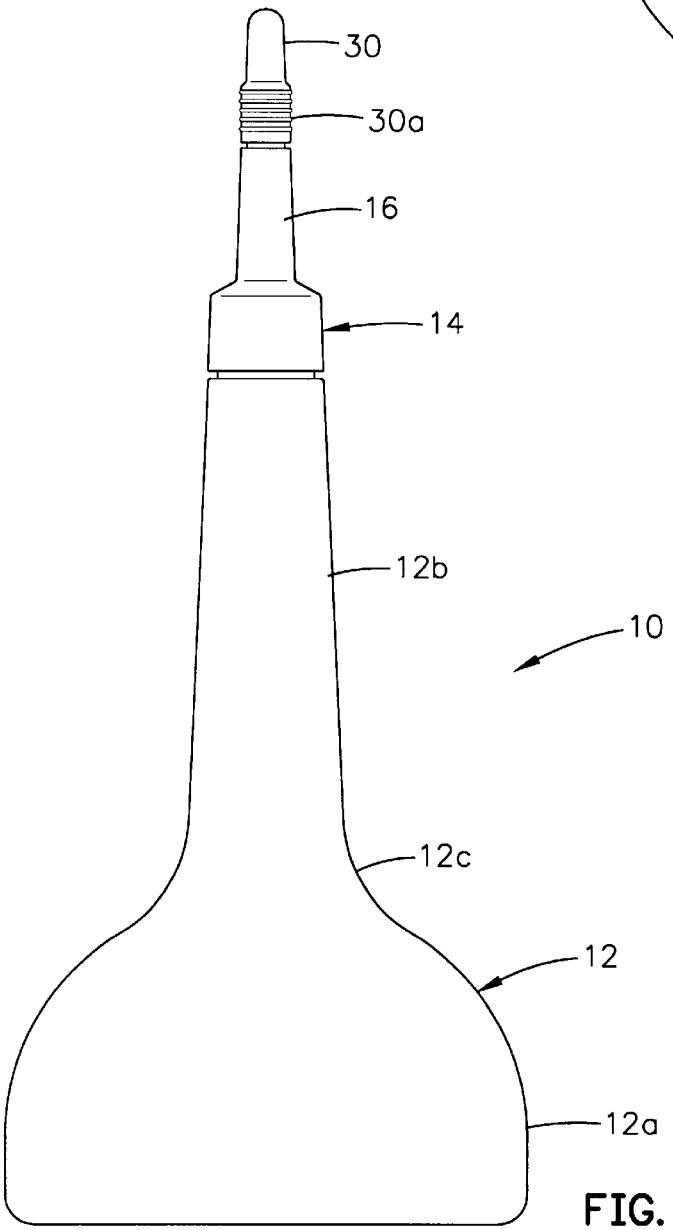
FIG. 4 is a slightly reduced side elevation view of the liquid dispensing container of FIG. 1.
Figure 12:
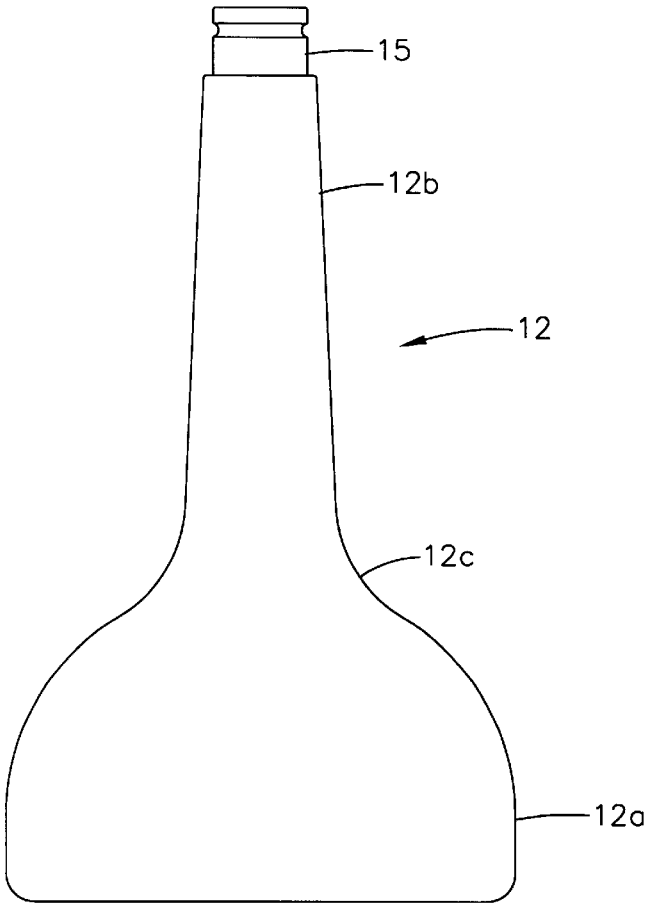
FIG. 12 is a reduced side elevation view of the bottle portion of the liquid dispensing container of FIG. 1.
Figure 14:
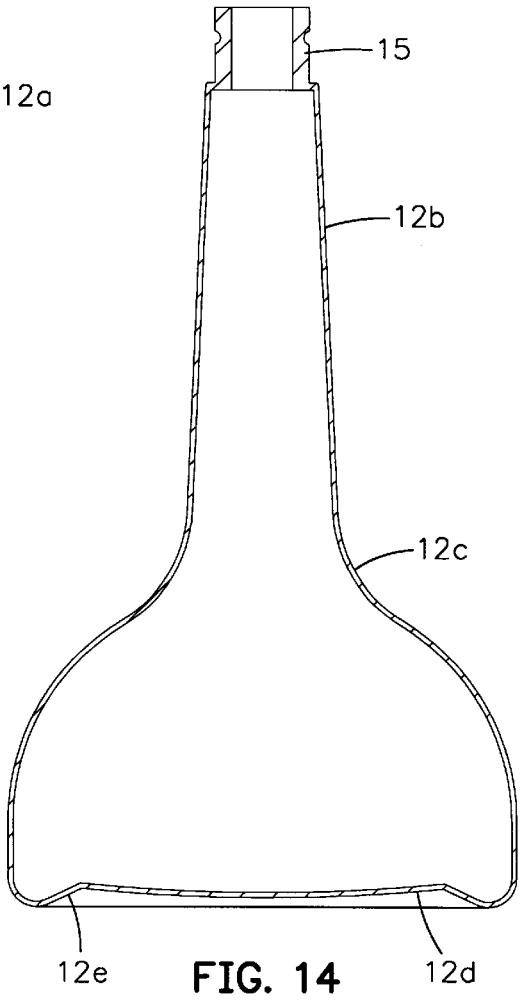
FIG. 14 is vertical sectional view of the bottle taken along line 14—14 of FIG. 13.
Figure 15:
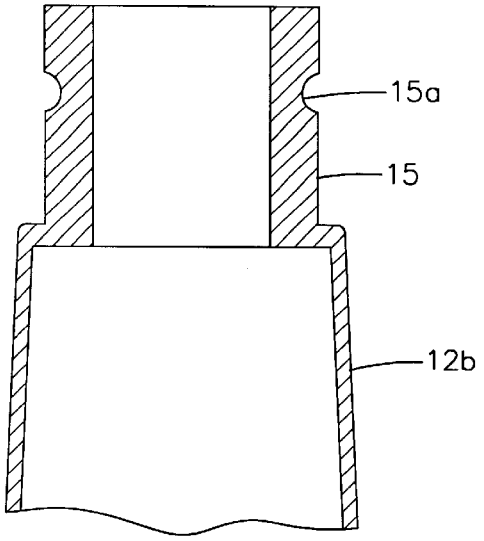
FIG. 15 is a greatly enlarged vertical sectional view of the upper end of the bottle of FIGS. 12 and 13, rotated ninety degrees.

Referring to the drawings, a liquid dispensing container 10 (FIG. 1) includes a reservoir in the form of a bottle 12 and a spout assembly 14 coupled to an open upper end of the bottle 12. The bottle 12 is preferably a unitary, i.e., monolithic, molded, at least partially deformable plastic bottle sized for holding a desired quantity of a liquid to be dispensed. By way of example, the bottle may be hold four ounces (118 milliliters) of a viscous liquid such as 3-IN-ONE® lubricating oil having a viscosity of 106.8 SUS at one hundred degrees F. The bottle 12 (FIG. 12) has a generally hemispherical lower base portion 12*a* and an elongated generally frusto-conical upper neck portion 12*b* for providing a low center of gravity to reduce the likelihood of inadvertent tipping over of the bottle 12. The lower base portion 12*a* and the upper neck portion 12*b* are connected by an intermediate concave portion 12*c* shaped and sized to provide a smooth transition between the upper and lower portions of the bottle 12, as best seen in FIG. 4. This provides the bottle 12 with an aesthetically pleasing appearance. The trademark of the product and other identifying information can be painted, silk screened or otherwise applied directly to the exterior surface of the bottle 12. However, it may be more economical and less problematic from a high volume manufacturing standpoint to apply a heat shrink plastic label (not shown) over the lower hemispherical base portion 12*a* of the bottle 12.

Figure 2:
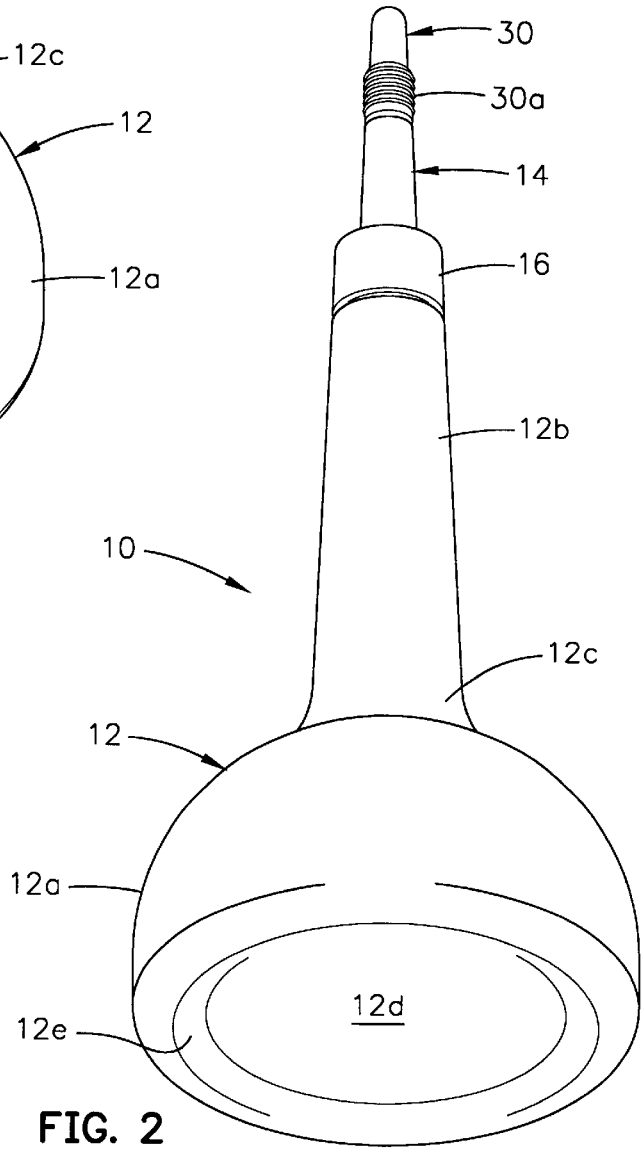
FIG. 2 is a perspective view of the liquid dispensing container of FIG. 1 taken from the bottom side thereof.
Figure 3:
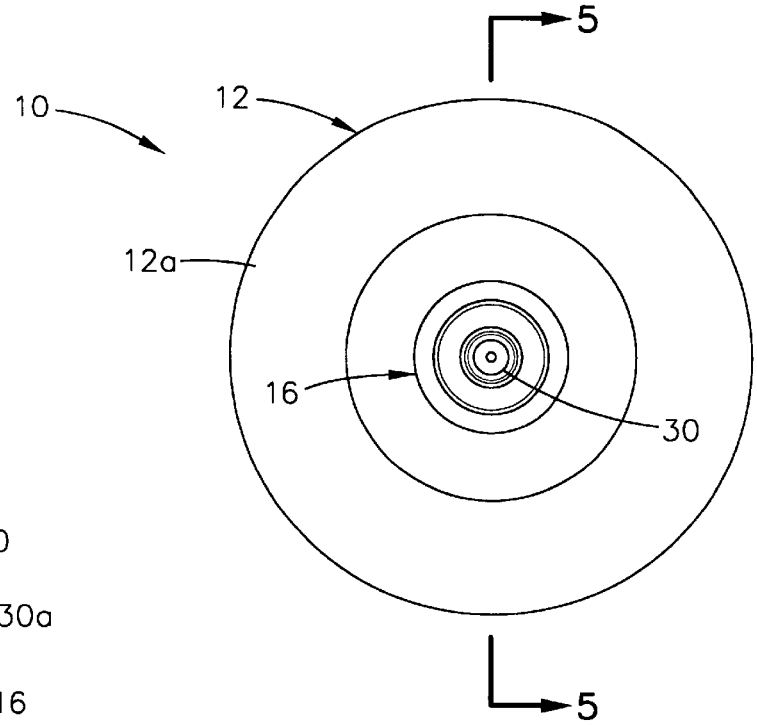
FIG. 3 is a slightly reduced top plan view of the liquid dispensing container of FIG. 1.
Figure 5:
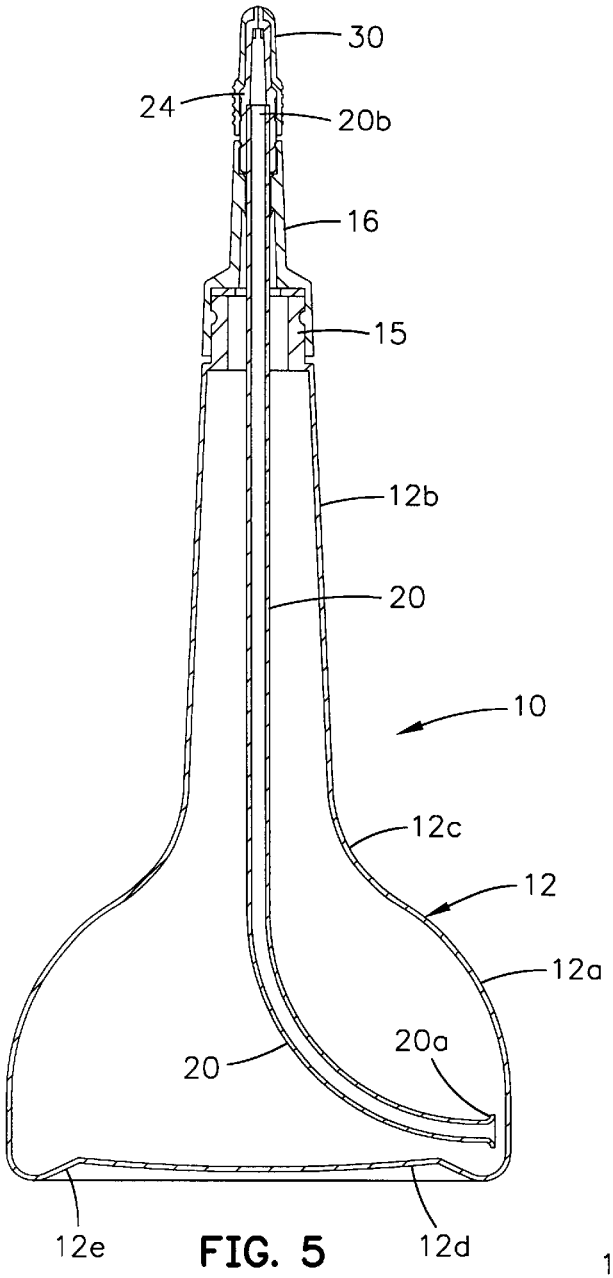
FIG. 5 is an enlarged vertical sectional view of the liquid dispensing container taken along line 5—5 of FIG. 3.

The bottle 12 is partially deformable in the sense that only a portion thereof is designed to be squeezed or flexed by the user's hand. The base portion 12*a* of the bottle 12 includes a flexible convex circular bottom wall portion 12*d* (FIGS. 2 and 5) that can be manually depressed by the user's thumb. When the bottle 12 is inverted, this pressing on the bottom wall portion 12d forces liquid from the bottle 12 through the upper neck portion 12*b*. A peripheral hinge portion 12*e* of the bottle 12 is upwardly inclined and connects the periphery of the central bottom wall portion 12*d* to the lower end of the hemispherical base portion 12*a* to facilitate upward (inward) flexing of the bottom wall portion 12*d*. The bottom wall portion 12*d* is slightly indented or recessed with respect to the hinge portion 12*e*.

The liquid dispensing container 10 is most comfortably grasped by inserting the intermediate portion 12*c* (FIG. 1) between the user's index finger and middle finger and pressing the thumb of the same hand against the bottom wall portion 12*d*. After the spout assembly 14 is extended and opened as hereafter described, and when the bottle 12 is inverted, the slight reduction in the internal volume of the bottle 12 caused by inward pressing on the bottom wall portion 12*d* with the thumb, combined with gravity, will force a small amount of the liquid through the spout assembly 14 for dispensing onto a surface or article of choice, in a very precise and controlled fashion. As will be explained in detail hereafter, there is an airtight seal between the spout assembly 12 and the neck portion 12*c* of the bottle 12, so that when the container 10 is inverted, slight inward movement of the bottom wall portion 12*d* will result in a slight increase in pressure inside the bottle 12.

By way of example, the bottle 12 may be fabricated by extrusion blow molding high density polyethylene (HDPE) so that the portions 12*a*, 12*b*, 12*c*, 12*d* and 12*e* have a non-uniform thickness of between approximately 0.025 inches and 0.090 inches. The terminal smaller diameter segment 15 (FIG. 12) of the neck portion 12*b* is thicker to provide increased rigidity and preferably has a thickness of approximately 0.125 inches. This extra rigidity is required for reliably coupling the spout assembly 14 to the neck portion 12*b* of the bottle 12 as hereafter described.

Figure 8:
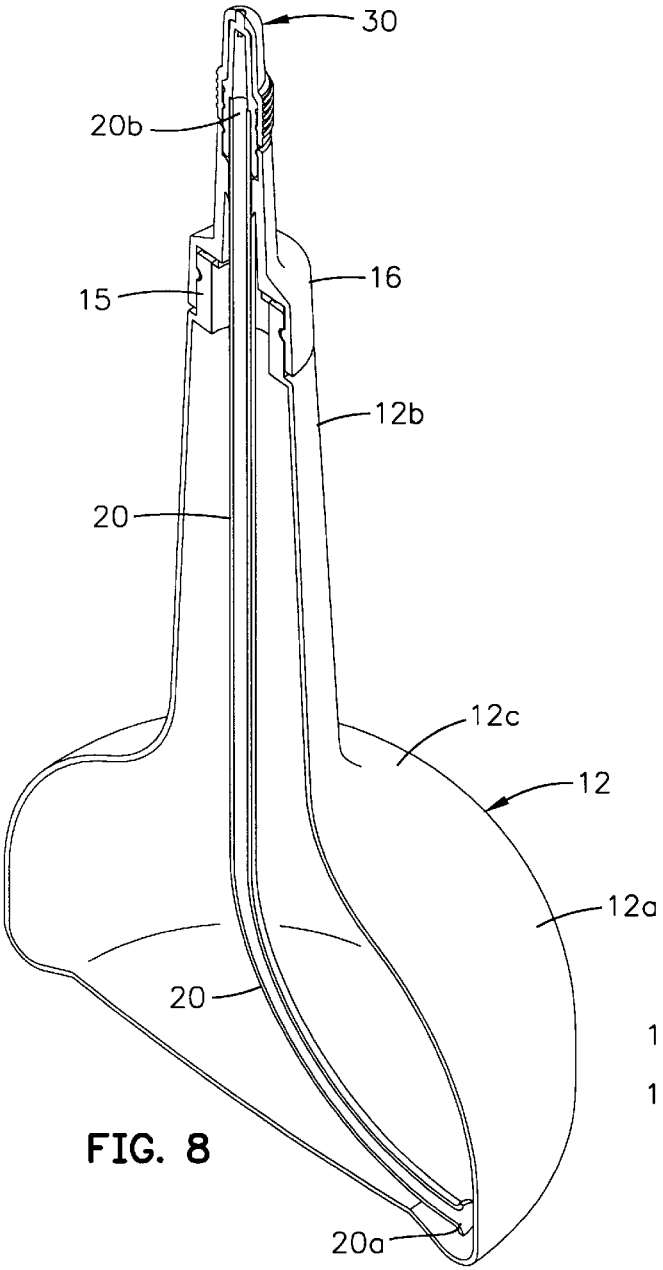
FIG. 8 is a perspective view similar to FIG. 1 showing the liquid dispensing container vertically sectioned with its dispensing tube in its fully retracted position. The cap liner washer is missing in this figure.
Figure 9:
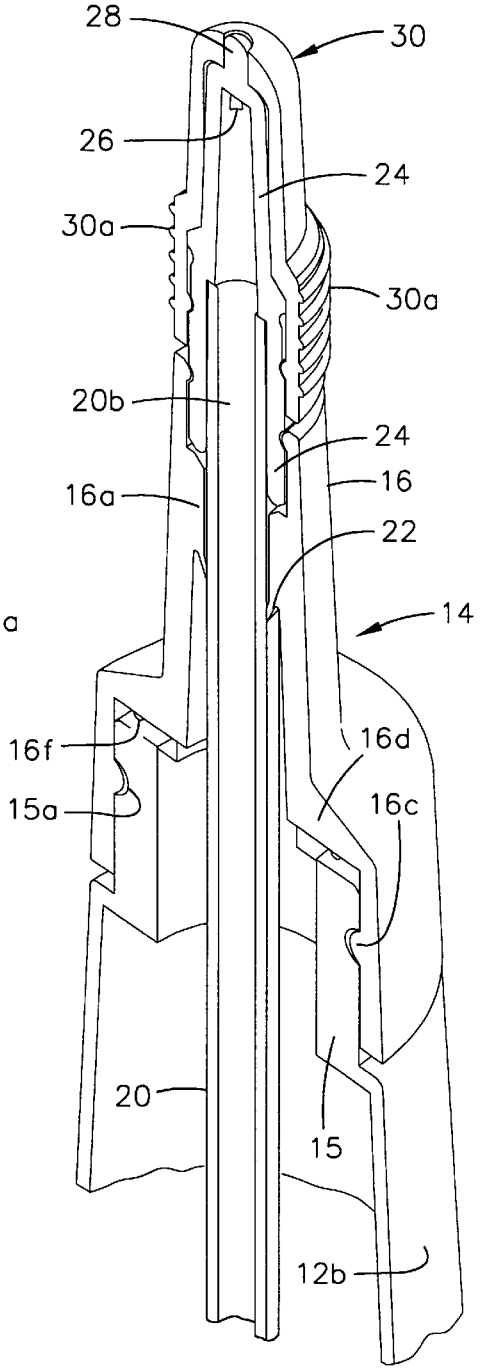
FIG. 9 is a greatly enlarged, vertically sectioned perspective view of the spout assembly shown in FIG. 8. The cap liner washer is missing in this figure.
Figure 16:
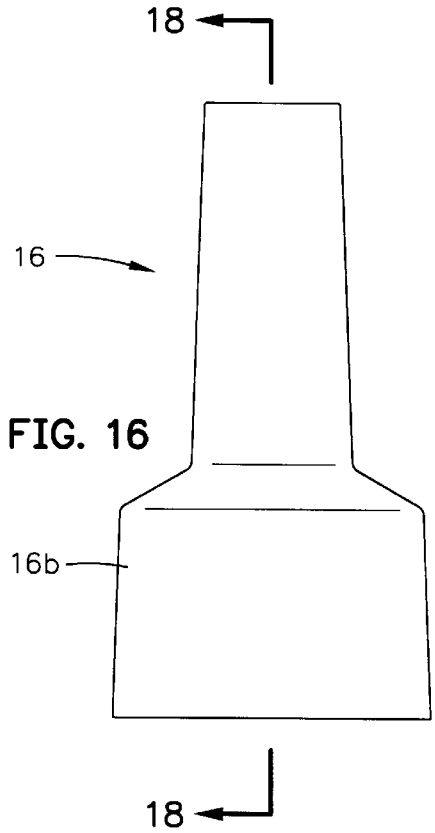
FIG. 16 is an enlarged side elevation view of the bottle cap of the liquid dispensing container of FIG. 1.
Figure 17:
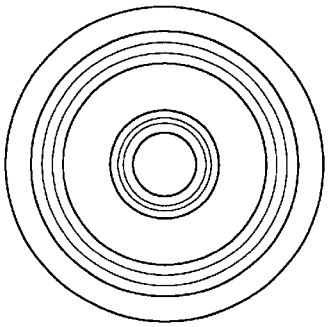
FIG. 17 is a top plan view of the bottle cap of FIG. 16.
Figure 18:
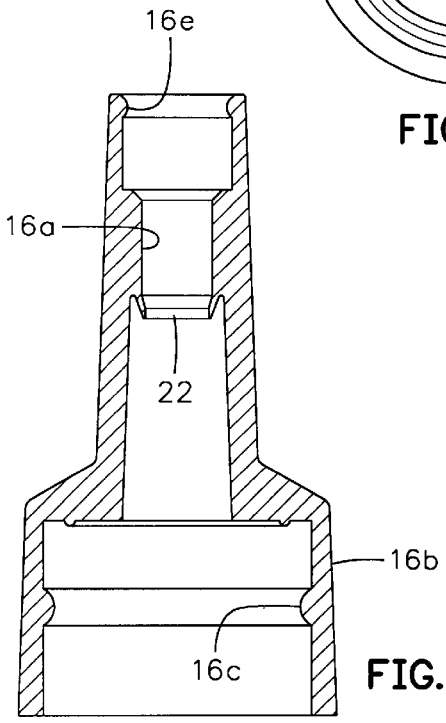
FIG. 18 is a vertical sectional view of the bottle cap taken along line 18—18 of FIG. 16.
Figure 19:
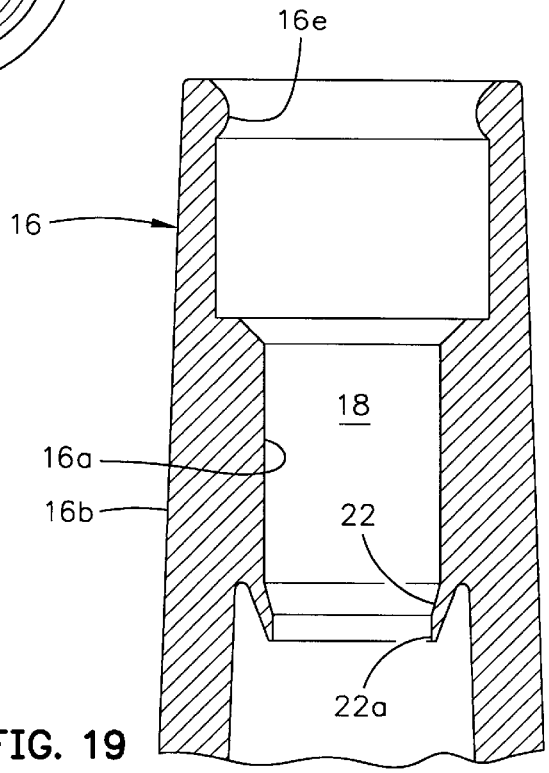
FIG. 19 is a greatly enlarged view of the upper end of the sectional view of the bottle cap of FIG. 18 showing details of its internal wiper element.

The spout assembly 14 (FIGS. 1 and 2) is coupled to the upper end of the neck portion 12*b* of the bottle 12 for dispensing a small portion of the quantity of liquid in the bottle when the flexible bottom wall portion 12*d* of the bottle 12 is manually depressed. The spout assembly 12 includes a generally cylindrical bottle cap 16 (FIG. 16) having a shoulder portion 16*a* (FIG. 19) defining the intermediate segment of an annular through bore 18. A flexible tube 20 (FIG. 8) is slidably extensible within the through bore 18 out of the bottle 12. The tube 20 is also slidably retractable within the through bore 18 back into the bottle 12. As best seen in FIG. 8, the length of the dispensing tube 20 is such that its lower portion curves to the peripheral edge of the base portion 12*a* of the bottle 12. The tube 20 has a flared or fluted proximal (lower) end 20*a* for receiving the quantity of liquid within the bottle 12 and a distal (upper) end 20*b* for delivering the liquid out of the bottle 12. The tube 20 is preferably made of clear, semi-rigid polyvinyl chloride (PVC). The flared proximal end 20*a* is thermally formed by simply holding the tube over and heat source which causes it to flare outwardly. The flared end 20*a* retains this shape after it cools. The flared proximal end 20*a* prevents the tube 20 from being fully withdrawn from the bottle 12 through the cap 16. Heating also makes the proximal end 20*a* more rigid.

Figure 6:
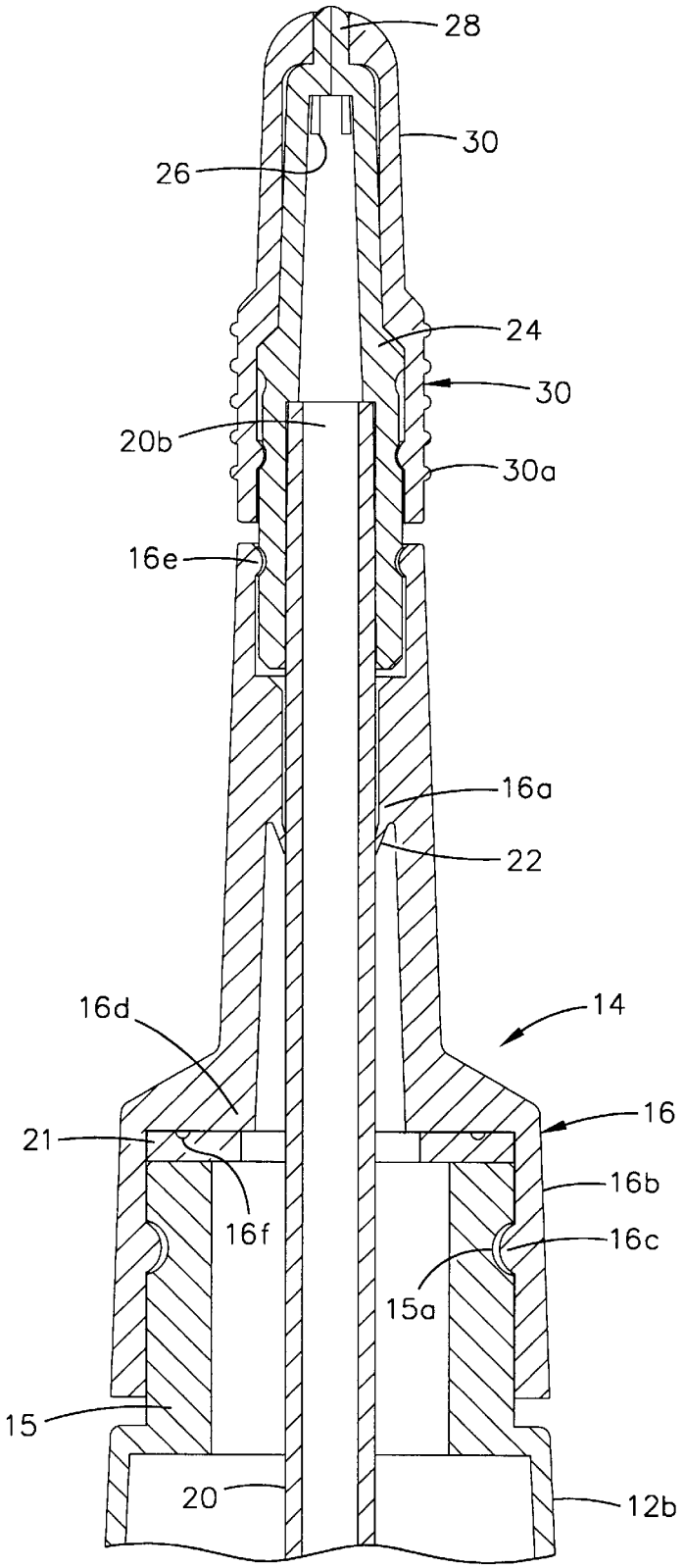
FIG. 6 is a greatly enlarged vertical sectional view of the spout assembly of the liquid dispensing container of FIGS. 1–5.
Figure 27:
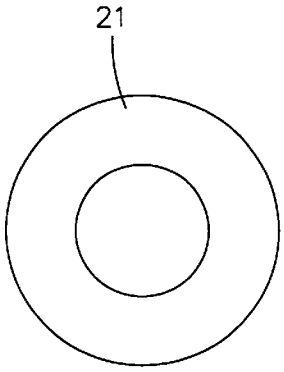
FIG. 27 is a greatly enlarged plan view of the cap liner washer of the liquid dispensing container of FIG. 1.
Figure 28:
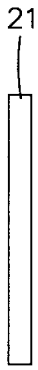
FIG. 28 is a side elevation view of the cap liner washer of FIG. 27.

The bottle cap 16 (FIGS. 16–19) is preferably injection molded out of low density polyethylene (LDPE). It includes a lower larger diameter cylindrical portion 16*b* with an internal annular rib 16*c*. The inner diameter of the lower portion 16*b* of the bottle cap 16 is sized to snugly fit over the terminal smaller diameter segment 15 (FIG. 12) of the neck portion 12*b* of the bottle 12. The rib l6*c* on the bottle cap 16 fits into a conformably shaped annular groove 15*a* in the terminal segment 15 of the neck portion 12*b* of the bottle 12, as best seen in FIG. 6. Preferably these parts are dimensioned so that during manufacture, the somewhat more pliant bottle cap 16 can be placed over the terminal segment 15, but cannot thereafter be easily removed from the bottle 12 by a user. A cap liner washer 21 (FIGS. 6, 27 and 28) is seated inside the lower portion 16*b* of the bottle cap 16 and is squeezed between shoulder 16*d* of the bottle cap and the top edge of the neck segment 15 as best seen in FIG. 6. The washer 21 is preferably made of a resilient deformable material such as F217 foamed polyethylene commercially available from Tri-Seal. The washer 21 is inserted into the bottle cap 16 and then the bottle cap 16 is mounted over the terminal segment 15 of the neck portion 12*b* of the bottle 12. The rib 16*c* and groove 15*a* are located such that the washer 21 is compressed when they mate. A boss 16*f* on the bottlecap 16 impinges on the upperside of the washer 21 to enhance the air tight seal.

An annular wiper element 22 (FIG. 19) extends radially inwardly and downwardly from the shoulder portion 16*a* of the bottle cap 16 for providing a substantially liquid impervious seal between the shoulder portion 16*a* of the bottle cap 16 and the tube 20. The wiper element 22 scrapes off substantially all of the liquid from the tube 20 when the tube 20 is slidably extended from the bottle 12. The wiper element 22 also serves to take up the tolerances that exist between the diameter of the through bore 18 and the outer diameter of the tube 20. This can be several thousandths of an inch. The wiper element 22 is resilient and flexible and bends back slightly away from the tube 20 while its tapered or beveled tip 22*a* maintains firm contact with the entire periphery of the tube 20. This not only ensures that liquid will not leak out from the bottle 12 between the tube 20 and the bottle cap 16, but also ensures that most of the excess liquid is removed from the outer surface of the tube 20 when the tube 20 is pulled out to its fully extended position illustrated in FIG. 10. Where the container 10 is used to dispense oil, this is very important as it ensures that oil does not get on the user's hands or clothing as a result of contact with the tube 20. It also ensures that oil doesn't drip onto the floor or other areas that are not supposed to receive lubrication. The wiper element 22 engages the flared proximal end 20*a* of the tube 20 to provide a stope limit to the extension of the tube 20 from the bottle cap 16.

Figure 20:
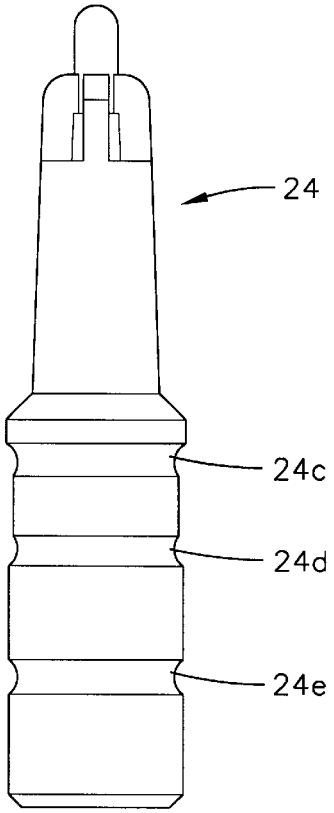
FIG. 20 is an enlarged side elevation view of the nozzle of the liquid dispensing container of FIG. 1.
Figure 21:
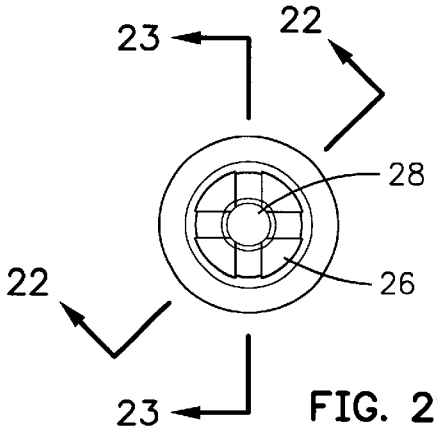
FIG. 21 is a top plan view of the nozzle of FIG. 20.
Figure 23:
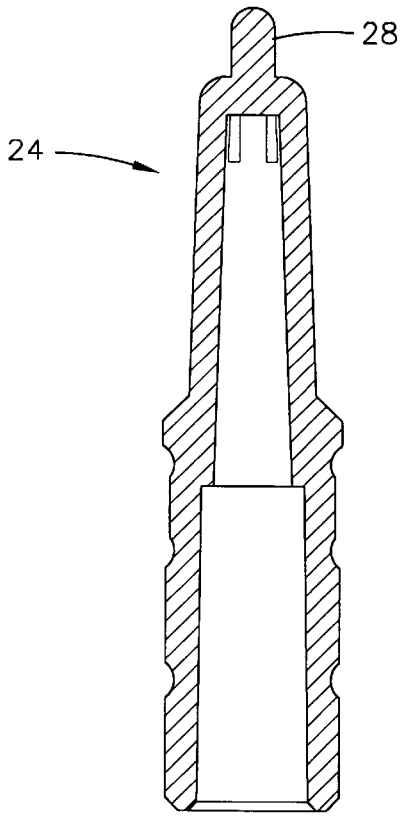
FIG. 23 is a longitudinal sectional view of the nozzle taken along line 23—23 of FIG. 21.
Figure 22:
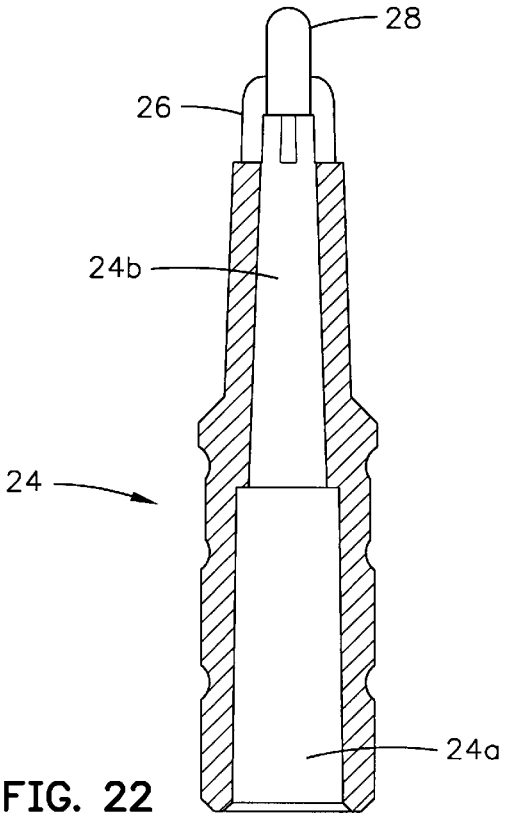
FIG. 22 is a longitudinal sectional view of the nozzle taken along line 22—22 of FIG. 21.

A generally cylindrical nozzle 24 (FIGS. 6 and 20) is permanently coupled to the distal end 20*b* of the tube 20. The distal end 20*b* of the tube 20 is preferably dipped in WELD-ON (Trademark) No. 4 PVC solvent (made by IPS Corporation of Garden Grove, Calif.) before it is forced into a rearwardly opening bore 24*a* in the nozzle 24. The bore 24*a* preferably has a two degree taper to snugly receive and hold the distal end 20*b* of the tube 20 before the chemical weld between the tube 20 and the nozzle 24 has completely formed. The nozzle 24 has four dispensing orifices 26 (FIGS. 21 and 22). The orifices 26 are spaced ninety degrees apart rearward of a small cylindrical teat or sealing plug 28 formed on the distal end of the nozzle 24. The orifices 26 communicate with a central bore 24*b* (FIG. 22) of the nozzle 24 that extends forwardly from the central bore 24*a*. The forward or distal end of the sealing plug 28 is rounded. The nozzle 24 is preferably injection molded out of the same HDPE plastic material as the bottle 12. The quadrature spaced, setback arrangement of the rectangular orifices 26 and the leading sealing plug 28 permits the nozzle 24 to be readily molded with a minimal amount of complexity in the tooling that would otherwise be required for other geometries.

Figure 7:
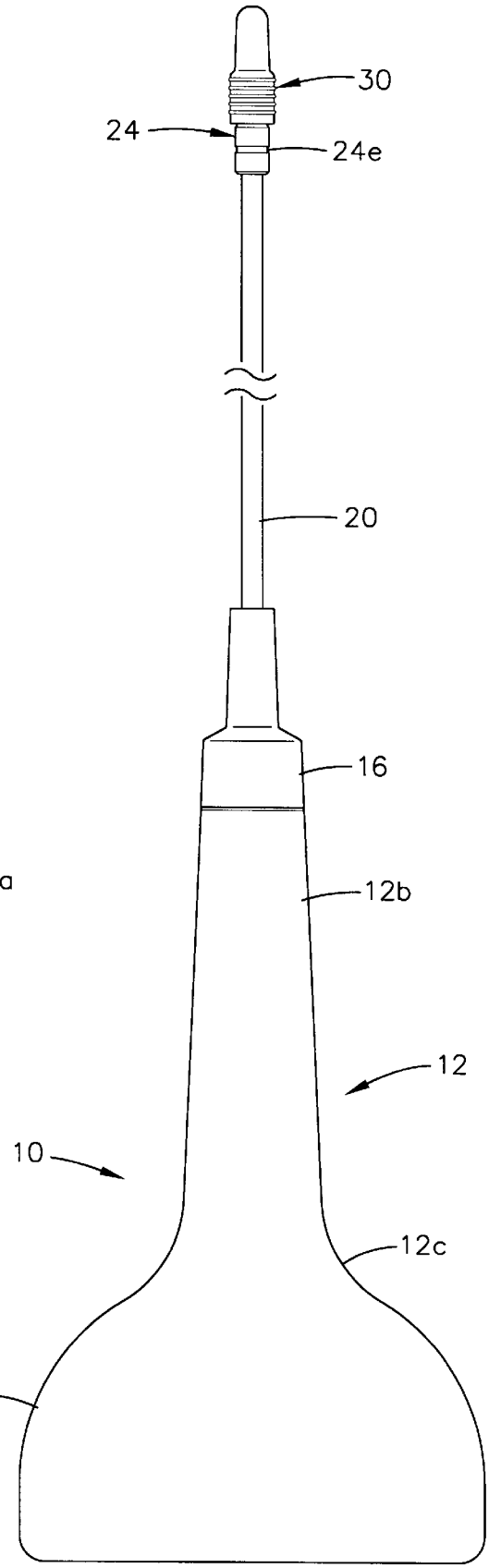
FIG. 7 is a side elevation view of the liquid dispensing container similar to FIG. 4 showing its dispensing tube in its fully extended position.
Figure 24:
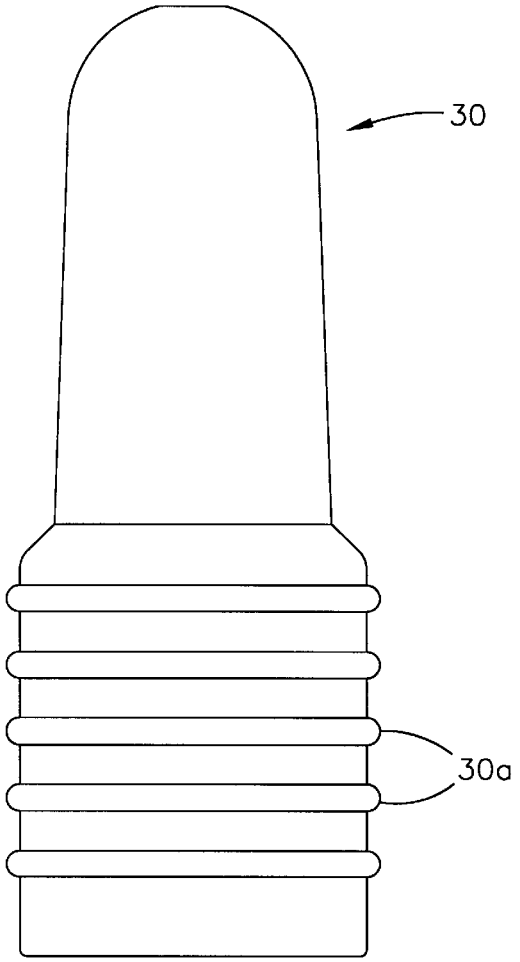
FIG. 24 is a greatly enlarged side elevation view of the pop-up cap of the liquid dispensing container of FIG. 1.
Figure 26:
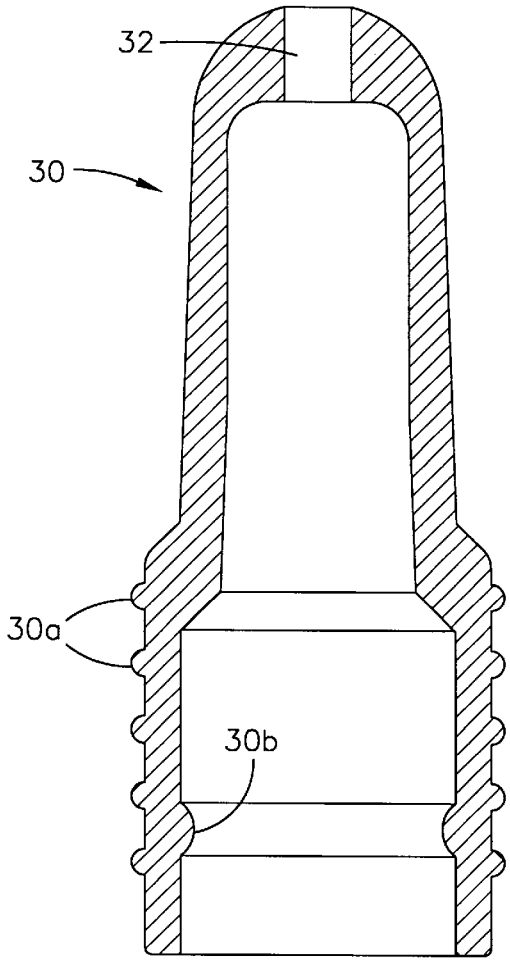
FIG. 26 is a longitudinal sectional view of the pop-up cap taken along line 26—26 of FIG. 25.
Figure 25:
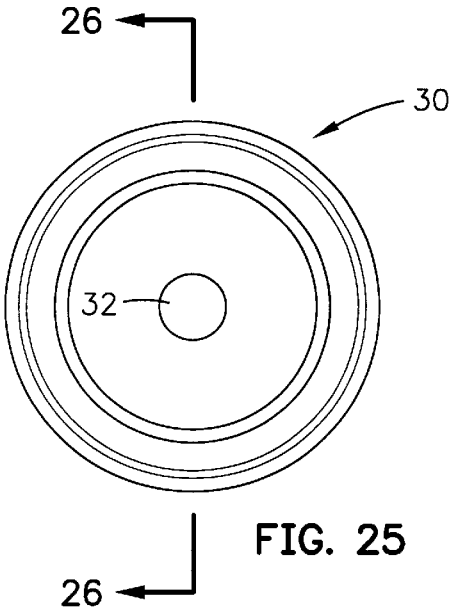
FIG. 25 is a top plan view of the pop-up cap of FIG. 24.

A generally cylindrical, hollow pop-up cap 30 (FIGS. 24–26) is coupled to the nozzle 24. More specifically, the pop-up cap fits over the nozzle 24 as best seen in FIG. 6. The pop-up cap 30 is selectively movable between retracted and extended positions for sealing and unsealing the dispensing orifices 26. The rounded distal end of the sealing plug 28 at the distal end of the nozzle 24 is snugly received in a hole 32 (FIGS. 25 and 26) in the pop-up cap 30 when the pop-up cap 30 is in its retracted position as illustrated in FIG. 6. The sealing plug 28 is withdrawn from the hole 32 when the pop-up cap is in its extended position illustrated in FIG. 7. The lower portion of the pop-up cap has a plurality of annular ribs 30*a* for facilitating gripping between the user's thumb and index finger. The interior annular wall of the pop-up cap 30 that defines a tapered through bore is formed with an annular ridge 30*b* (FIG. 26). The ridge 30*b* selectively mates with conformably shaped annular grooves 24*c* and 24*d* (FIG. 20) formed on the exterior annular wall of the nozzle 24 to define the extended and retracted positions of the pop-up cap 30. The pop-up cap 30 is preferably injection molded out of the same clear, semi-rigid polyvinyl chloride as the tube 20.

Figure 10:
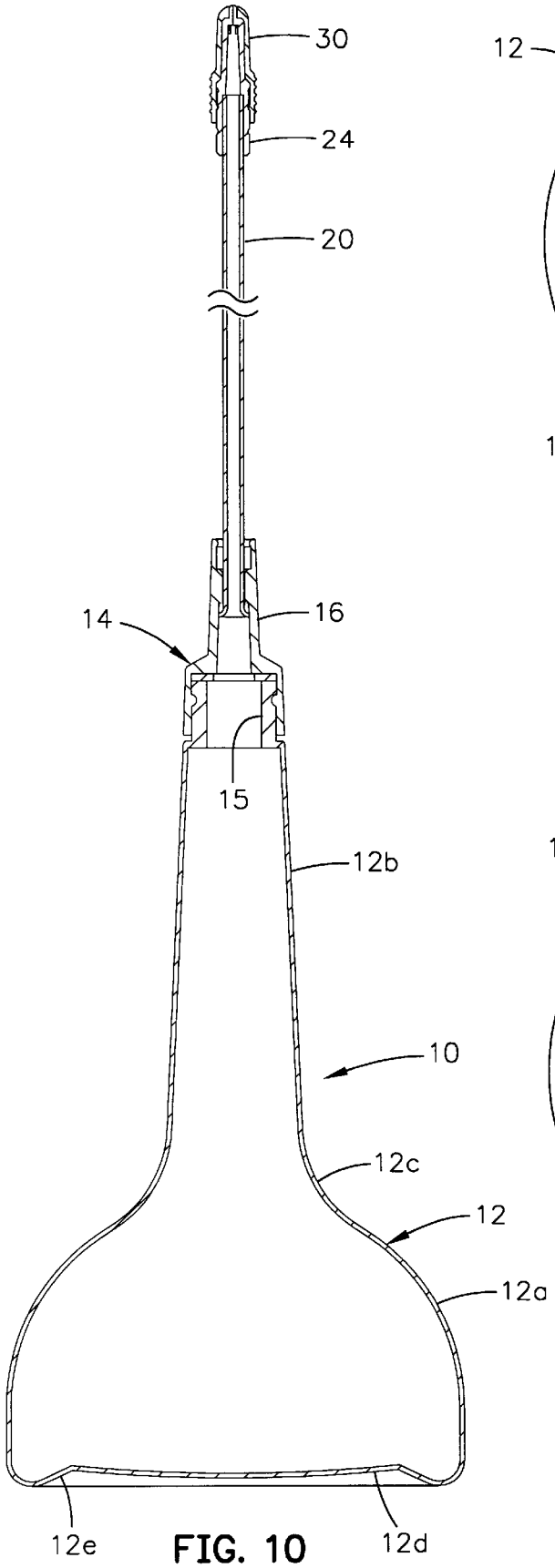
FIG. 10 is a view similar to FIG. 7 which has been vertically sectioned showing the dispensing tube in its fully extended position.
Figure 11:
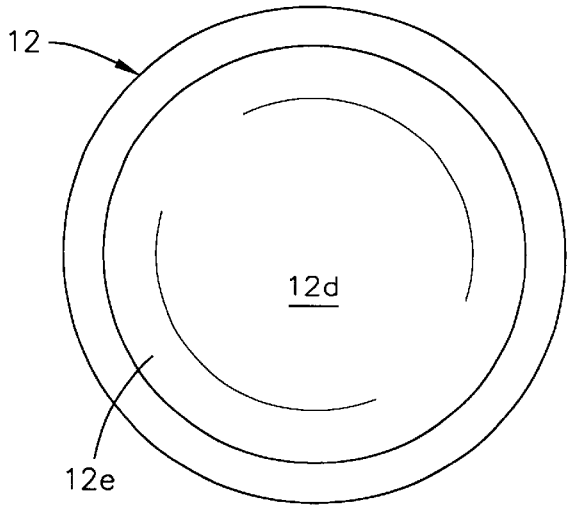
FIG. 11 is a bottom plan view of the liquid dispensing container of FIG. 1.
Figure 13:
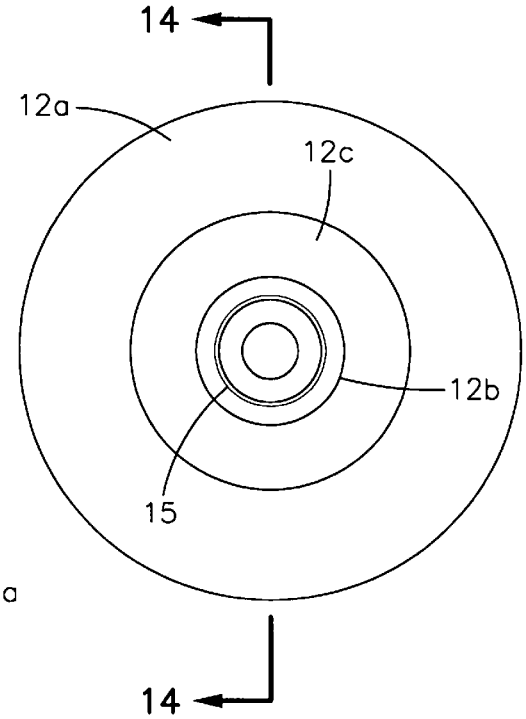
FIG. 13 is a top plan view of the bottle portion of the liquid dispensing container of FIG. 12.

When the dispensing tube 20 is pushed back into the bottle 12, an annular groove 24*e* (FIG. 20) formed in the outer surface of the rear end of the nozzle 24 mates with an annular ridge 16*e* (FIG. 6) in a socket formed the upper end of the bottle cap 16. The portions of the bottle cap 16 defining the socket are somewhat pliant to allow the rear end of the nozzle 24 to snap into place. This retains the dispensing tube 20 in its retracted position illustrated in FIG. 8. Preferably the tube 20 is both flexible and resilient. This allows the tube 20 to bend as illustrated in FIG. 8 when stored, thereby allowing the maximum length of dispensing tube to be fully retracted into the bottle 12. Upon full extension from the bottle 12 as shown in FIG. 10, the resilience of the tube 20 causes it to be generally straight, but allows it to bend and curve to apply oil, for example, to hard-to-reach areas.

Thus we have described a new type of liquid container with an extensible dispensing tube. Our liquid container can be inexpensively manufactured and assembled in very high volumes from molded plastic parts. The dispensing container 10 is highly functional in providing a dispenser that allows minute amounts of liquids, such as lubricating oil, to be dispensed in a very controlled fashion into otherwise inaccessible areas. The dispensing container 10 is lightweight and durable, and will not rust and/or corrode like conventional oil cans made out of sheet metal. The combination of a hemispherical lower base portion 12*a* and a frusto-conical upper neck portion 12*b* provides a container that has a very low center of gravity and is thus very stable when placed upright on a table, bench or other support surface. The combination of the intermediate concave portion 12*c* with the lower hemispherical base portion 12*a* and the upper tapered neck portion 12*b* also provides an aesthetically pleasing bottle shape, which in time can become highly distinctive to consumers. The shape of the bottle 12 in time will be strongly identified with the particular brand of lubricant or other liquid product dispensed therefrom.

The annular wiper element 22 inside the bottle cap 16 is particularly advantageous in that it provides dual important functions. First, the flexible, resilient wiper element 22 accommodates any tolerance variations in the diameter in the through bore in the bottle cap 16 relative to the outside diameter of the dispensing tube. Fore example, these tolerance variations can be as much as three to four thousands of an inch. The wiper element 22 therefore ensures against any leakage of liquid between the bottle cap 16 and the dispensing tube 20. This eliminates the need, for example, to mold the through bore in the bottle cap 16 with a plurality of axially extending rib-like bearing elements in the spout assembly as disclosed in U.S. Pat. No. 4,925,128 of Brody. Second, the wiper element 22 performs the important function of scraping off most of the liquid from the exterior surface of the dispensing tube 20 as the tube is pulled out of the bottle 12. This liquid would otherwise be present on the exterior surface of the tube 20 outside the bottle 12 where it could get onto the user's hands, clothing, etc. This would be undesirable, particular in the case of fluids such as oil which can stain and are difficult to clean off surfaces.

The nozzle 24 and its cooperating pop-up cap 30 provide a relatively non-complex, yet effective, simple to operate means for sealing the dispensing orifices 26 of the spout assembly 24. The pop-up cap 30 is affixed to the nozzle 24 in such a manner that it cannot be readily removed by the user. Thus it is very unlikely that the pop-up cap 30 will be misplaced or lost, leaving the user without a convenient way to effectively seal the distal end of the spout assembly 14.

While we have described a preferred embodiment of our liquid dispensing container, it will be understood by those of ordinary skill in the art that our invention can be modified in both arrangement and detail. For example, our spout assembly can be used with liquid bottles having different configurations than the hemispherical/frusto-conical configuration shown, The term bottle, as used herein refers to any type of liquid reservoir that can be partially deformed or otherwise made to deliver liquid therefrom through a spout assembly. The spout assembly of our invention need not include the nozzle and the pop-up nozzle cap as the distal end of the tube may be conventionally sealed. Furthermore, our arrangement of a nozzle and pop-up nozzle cap can be used with an extensible tube arrangement that does not include the wiper element. These and other modifications of our invention will occur to those of ordinary skill in the art and need not be described in detail, it being understood that the design illustrated herein and described with great particularity above is but one example of many implementations of our invention. Therefore, the protection afforded our invention should only be limited in accordance with the scope of the following claims.

We claim:

1. A liquid dispensing container, comprising:

a deformable bottle for holding a quantity of a liquid to be dispensed; and a spout assembly coupled to an open end of the bottle for selectively dispensing a small portion of the quantity of liquid in the bottle including a bottle cap having a through bore, a flexible tube slidably extensible within the through bore out of the bottle and slidably retractable within the through bore back into the bottle, the tube having a proximal end for receiving the quantity of liquid within the bottle and a distal end for delivering the liquid out of the bottle, and a frusto-conical wiper element with a beveled tip extending radially inwardly inside the bottle cap for providing a substantially liquid impervious seal between the bottle cap and the tube and scraping off liquid from the tube when the tube is slidably extended from the bottle.

2. The dispensing container of claim 1 and further comprising a nozzle coupled to the distal end of the tube and having at least one dispensing orifice, and a pop-up cap coupled to the nozzle and selectively movable between retracted and extended positions for sealing and unsealing the dispensing orifice.

3. The dispensing container of claim 1 wherein the bottle has a unitary molded constructions including a generally hemispherical lower base portion and an elongated generally frusto-conical neck portion to which the spout assembly is coupled.

4. The dispensing container of claim 3 wherein the base portion of the bottle includes a flexible bottom wall portion that can be manually depressed to force liquid from the bottle into the tube.

5. The dispensing container of claim 1 wherein the wiper element extends radially inwardly and downwardly from a shoulder portion of the bottle cap.

6. The dispensing container of claim 1 wherein the deformable bottle has a neck portion with a circumferentially extending groove and the bottle cap has a circumferentially extending rib that mates with the groove to retain the bottle cap on the neck portion.

7. The dispensing container of claim 2 wherein an exterior surface of a rear end of the nozzle is sized and configured to removably snap into an upper end of the bottle cap.

8. The dispensing container of claim 2 wherein an interior through bore in of a rear end of the nozzle is tapered for holding the distal end of the tube.

9. The dispensing container of claim 2 wherein the nozzle is formed with a sealing plug at its distal end which is received in a hole in the pop-up cap when the pop-up cap is in its retracted position and which is withdrawn from the hole when the pop-up cap is in its extended position.

10. The dispensing container of claim 2 wherein an exterior surface of the pop-up cap is formed with a plurality of circumferentially extending ribs for facilitating gripping of the cap between a user's thumb and index finger.

11. A liquid dispensing container, comprising:

a deformable bottle for holding a quantity of a liquid to be dispensed; and a spout assembly coupled to an end of the bottle for selectively dispensing a small portion of the quantity of liquid in the bottle including a bottle cap having a through bore, a flexible tube slidably extensible within the through bore out of the bottle and slidably retractable within the through bore back into the bottle, the tube having a proximal end for receiving the quantity of liquid within the bottle and a distal end for delivering the liquid out of the bottle, a nozzle coupled to the distal end of the tube and having at least one dispensing orifice, and a pop-up cap non-removably coupled to the nozzle and selectively movable between retracted and extended positions for sealing and unsealing the dispensing orifice, the retracted and extended positions being defined by an annular ridge on the cap that selectively mates with spaced apart annular grooves on the nozzle.

12. The dispensing container of claim 11 and further comprising a wiper element extending radially inwardly from the bottle cap adjacent the through bore for providing a substantially liquid impervious seal between the bottle cap and the tube and scraping off liquid from the tube when the tube is slidably extended from the bottle.

13. The dispensing container of claim 11 wherein the bottle has a generally hemispherical lower base portion and an elongated generally frusto-conical neck portion to which the spout assembly is coupled.

14. The dispensing container of claim 13 wherein the base portion of the bottle includes a flexible bottom wall portion that can be manually depressed to force liquid from the bottle into the tube.

15. The dispensing container of claim 12 wherein the wiper element extends radially inwardly and downwardly from a shoulder portion of the bottle cap.

16. The dispensing container of claim 11 wherein the deformable bottle has a neck portion with a circumferentially extending groove and the bottle cap has a circumferentially extending rib that mates with the groove to retain the bottle cap on the neck portion.

17. The dispensing container of claim 11 wherein an exterior surface of a rear end of the nozzle is sized and configured to removably snap into an upper end of the bottle cap.

18. The dispensing container of claim 11 wherein an interior through bore in a rear end of the nozzle is tapered for holding the distal end of the tube.

19. The dispensing container of claim 11 wherein the nozzle is formed with a sealing plug at its distal end which is received in a hole in the pop-up cap when the pop-up cap is in its retracted position and which is withdrawn from the hole when the pop-up cap is in its extended position.

20. The dispensing container of claim 14 wherein the bottom wall portion includes an outwardly convex central portion and a surrounding peripheral hinge portion.

21. A liquid dispensing container, comprising:

a deformable bottle for holding a quantity of a liquid to be dispensed, the bottle having a unitary molded construction including a generally hemispherical lower base portion and an elongated neck portion; and a spout assembly coupled to the neck portion of the bottle for selectively dispensing a small portion of the quantity of liquid in the bottle including a bottle cap having a through bore, a cap liner washer squeezed between a shoulder of the bottle cap and a top edge of the elongated neck portion, and a flexible tube slidably extensible within the through bore out of the bottle and slidably retractable within the through bore back into the bottle, the tube having a proximal end for receiving the quantity of liquid within the bottle and a distal end for delivering the liquid out of the bottle.

22. The dispensing container of claim 21 wherein the base portion of the bottle includes a flexible bottom wall portion that can be manually depressed to force liquid from the bottle into the tube.

23. The dispensing container of claim 22 wherein the bottom wall portion includes an outwardly convex central portion and a surrounding peripheral hinge portion.

24. The dispensing container of claim 21 and further comprising a nozzle coupled to the distal end of the tube and having at least one dispensing orifice, and a pop-up cap coupled to the nozzle and selectively movable between retracted and extended positions for sealing and unsealing the dispensing orifice.

25. The dispensing container of claim 21 wherein the spout assembly further includes an annular wiper element extending radially inwardly from a shoulder portion of the bottle cap for providing a substantially liquid impervious seal between the shoulder portion of the bottle cap and the tube and scraping off liquid from the tube when the tube is slidably extended from the bottle.

26. The dispensing container of claim 25 wherein the wiper element extends radially inwardly and downwardly from the shoulder portion of the bottle cap.

27. The dispensing container of claim 21 wherein the neck portion has a frusto-conical shape and includes a circumferentially extending groove adjacent an upper end of the neck portion and the bottle cap has a circumferentially extending rib that mates with the groove to retain the bottle cap on the neck portion.

28. The dispensing container of claim 24 wherein an exterior surface of a rear end of the nozzle is sized and configured to removably snap into an upper end of the bottle cap.

29. The dispensing container of claim 24 wherein an interior through bore in of a rear end of the nozzle is tapered for holding the distal end of the tube.

30. The dispensing container of claim 24 wherein the nozzle is formed with a sealing plug at its distal end which is received in a hole in the pop-up cap when the pop-up cap is in its retracted position and which is withdrawn from the hole when the pop-up cap is in its extended position.

31. A liquid dispensing container, comprising:

a unitary molded bottle for holding a quantity of a liquid to be dispensed, the bottle having a generally hemispherical lower base portion and an elongated upper neck portion for providing a low center of gravity to reduce the likelihood of inadvertent tipping over of the bottle, the base portion of the bottle including a deformable bottom wall portion that can be manually depressed to force liquid from the bottle through the neck portion, the bottom wall portion including an outwardly convex central portion and a surrounding peripheral hinge portion; and a spout assembly coupled to an upper end of the neck portion of the bottle for dispensing a small portion of the quantity of liquid in the bottle when the flexible bottom wall portion of the bottle is manually depressed.

32. The dispensing container of claim 31 wherein the neck portion has a frusto-conical shape.

33. The dispensing container of claim 31 wherein the bottle is configured such that there is a smooth transition between an upper end of the hemispherical base portion and a lower end of the neck portion.

34. The dispensing container of claim 31 wherein the spout assembly includes a bottle cap coupled to an upper end of the neck portion, the bottle cap having a through bore.

35. The dispensing container of claim 34 and further comprising a flexible tube slidably extensible within the through bore out of the bottle and slidably retractable within the through bore back into the bottle, the tube having a proximal end for receiving the quantity of liquid within the bottle and a distal end for delivering the liquid out of the bottle.

36. The dispensing container of claim 35 and further comprising a nozzle coupled to the distal end of the tube and having at least one dispensing orifice, and a pop-up cap coupled to the nozzle and selectively movable between retracted and extended positions for sealing and unsealing the dispensing orifice.

37. The dispensing container of claim 35 wherein the spout assembly further includes an annular wiper element extending radially inwardly inside the bottle cap for providing a substantially liquid impervious seal between the shoulder portion of the bottle cap and the tube and scraping off liquid from the tube when the tube is slidably extended from the bottle.

38. The dispensing container of claim 34 wherein the upper end of the neck portion includes an annular groove adjacent an upper end of the neck portion and the bottle cap has a circumferentially extending rib that mates with the annular groove to retain the bottle cap on the neck portion.

39. A liquid dispensing container, comprising:

a unitary, molded plastic bottle for holding a quantity of a liquid to be dispensed, the bottle having a generally hemispherical lower base portion and an elongated generally frusto-conical upper neck portion for providing a low center of gravity to reduce the likelihood of inadvertent tipping over of the bottle, the base portion including a deformable bottom wall portion that can be manually depressed to force liquid from the bottle through the neck portion; and a spout assembly coupled to an upper end of the neck portion for dispensing a small portion of the quantity of liquid in the bottle when the flexible bottom wall portion of the bottle is manually depressed, including a bottle cap having a shoulder portion defining an annular through bore, a flexible tube slidably extensible within the through bore out of the bottle and slidably retractable within the through bore back into the bottle, the tube having a proximal end for receiving the quantity of liquid within the bottle and a distal end for delivering the liquid out of the bottle, an annular wiper element extending radially inwardly and downwardly adjacent the shoulder portion of the bottle cap for providing a substantially liquid impervious seal between the shoulder portion of the bottle cap and the tube and scraping off liquid from the tube when the tube is slidably extended from the bottle, a nozzle coupled to the distal end of the tube and having at least one dispensing orifice, and a pop-up cap coupled to the nozzle and selectively movable between retracted and extended positions for sealing and unsealing the dispensing orifice, the nozzle being formed with a sealing plug at its distal end which is received in a hole in the pop-up cap when the pop-up cap is in its retracted position and which is withdrawn from the hole when the pop-up cap is in its extended position.

40. A liquid dispensing container, comprising:

a deformable bottle for holding a quantity of a liquid to be dispensed; and a spout assembly coupled to an end of the bottle for selectively dispensing a small portion of the quantity of liquid in the bottle including a bottle cap having a through bore, a flexible tube slidably extensible within the through bore out of the bottle to an extended position and slidably retractable within the through bore back into the bottle to a retracted position, the tube having a proximal end for receiving the quantity of liquid within the bottle and a distal end for delivering the liquid out of the bottle, a nozzle coupled to the distal end of the tube and having at least one dispensing orifice, and means for retaining the tube in the retracted position.

* * * * *